US010920353B2

(12) United States Patent
Morimoto et al.

(10) Patent No.: US 10,920,353 B2
(45) Date of Patent: Feb. 16, 2021

(54) SEWING MACHINE

(71) Applicant: Janome Sewing Machine Co., Ltd., Tokyo (JP)

(72) Inventors: Shuzo Morimoto, Tokyo (JP); Jun Mafune, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 485 days.

(21) Appl. No.: 15/882,003

(22) Filed: Jan. 29, 2018

(65) Prior Publication Data

US 2018/0216272 A1 Aug. 2, 2018

(30) Foreign Application Priority Data

Jan. 31, 2017 (JP) ..... 2017-015702

(51) Int. Cl.

| | |
|---|---|
| ***D05B 55/14*** | (2006.01) |
| ***D05B 69/00*** | (2006.01) |
| ***D05B 3/02*** | (2006.01) |
| ***D05B 55/02*** | (2006.01) |
| ***D05B 87/02*** | (2006.01) |
| *D05B 69/02* | (2006.01) |

(52) U.S. Cl.

CPC ..... *D05B 55/14* (2013.01); *D05B 3/02* (2013.01); *D05B 55/02* (2013.01); *D05B 69/00* (2013.01); *D05B 87/02* (2013.01); *D05B 69/02* (2013.01)

(58) Field of Classification Search

CPC ..... D05B 3/02; D05B 55/14; D05B 69/02
USPC ..... 112/221
See application file for complete search history.

(56) References Cited

U.S. PATENT DOCUMENTS 3,266,449 A * 8/1966 Berg ..... D05B 3/02 112/221
4,108,096 A * 8/1978 Ciecior ..... D05B 3/02 112/221

(Continued)

FOREIGN PATENT DOCUMENTS

DE 4036436 A1 9/1991
DE 102006061348 A1 8/2007

(Continued)

OTHER PUBLICATIONS

Extended European Search Report dated May 23, 2018 in corresponding European Patent Application No. EP 18153864.6.

(Continued)

*Primary Examiner* — Nathan E Durham
(74) *Attorney, Agent, or Firm* — Nath, Goldberg & Meyer; Jerald L. Meyer

(57) ABSTRACT

A needle bar 4 is supported by a needle bar supporter in a manner freely movable up and down relative to a frame. A crank 2 is fixed to an upper shaft 1, rotates with the upper shaft 1, and an output end thereof moves circularly. A crank rod 3 is connected to the crank 2 in a freely rotatable manner. A connection rod 8 is connected to an intermediate portion of the crank rod 3 in a freely rotatable manner, and is connected to the needle bar 4 in a freely rotatable manner. A length of the needle bar 4 and a length from a connecting position of the connection rod 8 and the crank rod 3 to a slider 7 differ. When the crank 2 circularly moves, the connecting position of the connection rod 8 and the crank rod 3 draws a trajectory of an ellipse.

7 Claims, 10 Drawing Sheets

(56) References Cited

U.S. PATENT DOCUMENTS

| | | | | | |
|---|---|---|---|---|---|
| 4,719,865 | A * | 1/1988 | Yokoe | D05B 49/02 | 112/163 |
| 5,007,355 | A * | 4/1991 | Yanagisawa | D05B 55/14 | 112/221 |
| 2015/0354116 | A1 * | 12/2015 | Koike | D05B 57/32 | 112/220 |
| 2016/0122929 | A1 | 5/2016 | Koike et al. | | |

FOREIGN PATENT DOCUMENTS

| | | | | | |
|---|---|---|---|---|---|
| EP | 3075894 | A1 | | 10/2016 | |
| GB | 2073794 | A | | 4/1981 | |
| JP | S52-17784 | A | | 2/1977 | |
| JP | 2002166077 | A | * | 6/2002 | F05B 3/02 |
| JP | 2003024664 | A | * | 1/2003 | D05B 3/02 |
| TW | 201636472 | A | | 10/2016 | |

OTHER PUBLICATIONS

Taiwanese Office Action dated Sep. 14, 2018 corresponding to application No. 106137867.

* cited by examiner

THE RELATION BETWEEN THE ROTATION ANGLE OF THE UPPER SHAFT 1 AND THE POSITION OF THE NEEDLE POINT (C)

THE RELATION BETWEEN THE UPPER SHAFT ANGLE AND THE SLIDER 7, AND THE TRAJECTORY OF NEEDLE POINT (C)

SEWING MACHINE

CROSS-REFERENCE TO RELATED APPLICATION

This application is based upon and claims the benefit of priority from Japan Patent Application No. 2017-015702, filed on Jan. 31, 2017, the entire contents of which are incorporated herein by reference.

FIELD OF THE INVENTION

Embodiments of the present disclosure relate to a sewing machine with an improved driving mechanism of a needle bar.

BACKGROUND

A sewing machine intertwines a needle thread and a bobbin thread to forma stitch. The needle thread is inserted to a needle, and the bobbin thread is wound to a bobbin and housed in a shuttle. A method to form the stitch (a stitch formation cycle) is as follows:

(1) A needle descends and pierces a fabric that is a product to be sewed.

(2) The needle rises from a bottom dead center and forms a loop in the needle thread.

(3) A projection (a point) of a rotating shuttle catches the loop, and the bobbin thread passes through the loop together with the bobbin to intertwine the needle thread and the bobbin thread.

(4) The needle rises and is pulled out from the fabric, and a fabric feeding mechanism moves the fabric in a predetermined amount.

A plurality of the stitches is linearly formed by repeating the above (1) to (4).

A formation of the loop is explained below. As illustrated in FIG. 9, the loop changes its size in accordance with a position of the needle. FIG. 9 embodiment (a) illustrates a bottom dead center of the needle, and FIG. 9 embodiment (b) illustrates a state (δ1) in which the needle piercing the fabric is slightly risen from the bottom dead center, and in this state, since no gap is produced between the needle thread and the needle, the point of the shuttle cannot enter the loop. FIG. 9 embodiment (c) illustrates a state (δ2) in which the needle is risen by certain amount producing the loop, and when a needle point and the point of the shuttle intersect, the point of the shuttle catches the loop, and the needle thread and the bobbin thread is intertwined. FIG. 9 embodiment (d) illustrates a state (δ3) indicating an allowable maximum needle displacement amount for the point of the shuttle to enter the loop. FIG. 9 embodiment (e) illustrates a state (δ4) in which the needle is risen too much, and in this state, since the loop collapses, the point of the shuttle cannot enter the loop. That is, in FIG. 9, to form an appropriate stitch, the needle and the point of the shuttle must intersect when a needle point position is in between the state (δ2) and the state (δ3). It should be noted that, as illustrated in FIG. 6, a range of an upper shaft angle indicating the needle point position in between the state (δ2) and the state (δ3) is defined as an appropriate loop range W.

The needle which the needle thread passes through is supported by a needle bar. A lifting mechanism having a motor as a driving source drives the needle bar to move a needlepoint from above a needle plate to below the needle plate. A conventional lifting mechanism is so-called slider crank mechanism as illustrated in FIG. 8 and FIG. 10 embodiment (a) as an example. This slider crank mechanism converts the rotation motion of an upper shaft 1 to the linear motion of a shaft 4*a* (that is, a needle 6) via a crank 2 and a crank rod 3, and FIG. 10 embodiment (c) illustrates an angle of the upper shaft 1 and a trajectory of the needle point. As illustrated in a diagrammatic drawing of FIG. 10 embodiment (c), the trajectory of the needle point in the conventional technology is not the sine curve due to its mechanical characteristic. In addition, since the needle point position of when the angle of the upper shaft 1 is 90° or 270° is higher than the middle point of an entire stroke (S6) of the needle 6, a time for the needle 6 to move from the middle point of S6 to the bottom dead center is shorter than a time for the needle 6 to move from a top dead center to the middle point of S6. This difference in time affects a moving speed of the needle 6, and a relation between an acceleration at a phase where the movement of the needle bar shifts from falling to rising and an acceleration at a phase where the movement of the needle bar shifts from rising to falling is not symmetrical. That is, the acceleration at the phase where the movement of the needle bar shifts from falling to rising is larger. Generally, this difference between the acceleration near the bottom dead center and near the top dead center is known as one of the causes that increases the vibration of the sewing machine, and its effect on a straight line sewing machine which operates in high-speed is significant.

On the other hand, the fact that the time for the needle point to move from middle point of S6 to the bottom dead center is shorter than a time for the needle point to move from the top dead center to the middle point of S6 also affects a zigzag sewing machine. The zigzag sewing machine performs a zigzag sewing and a pattern sewing by changing right and left needle dropping positions by swinging the entire needle bar without changing a position of the shuttle. Therefore, the relative positional relation of the needle and the shuttle changes due to the swinging of the needle bar, and the mutual operation timing of the needle and the shuttle necessary for sewing is affected. Since the operation timing is mainly near the bottom dead center, when the acceleration near the bottom dead center is large, it means that an effect given to the operation timing by the change of the relative positional relation of the needle and the shuttle due to the swinging of the needle bar is large.

To address the above problem, for example as illustrated in FIG. 10 embodiment (b), a length of the crank rod 3 may be extended to make the trajectory of the needlepoint closer to the sine curve (that is, to spread the trajectory). FIG. 10 embodiment (c) illustrates the trajectory of the needle point in cases the upper shaft 1 is positioned to have a stroke of the needlepoint in FIG. 10 embodiments (a) and (b) consistent with each other. For example, assume that a mechanism of FIG. 10 embodiment (a) is adjusted to have the stroke of the needle point unchanged and the trajectory of the needle point as same as a trajectory of an embodiment of the present disclosure illustrated in FIG. 2 embodiment (a). In other word, assume that the trajectory of the needle point of FIG. 10 embodiment (a) is changed to the trajectory of FIG. 10 embodiment (b). In the slider crank mechanism illustrated in FIG. 10, a length of the crank 2 affects the stroke of the needle point, and the length of the crank rod 3 affects the trajectory of the needle point. In addition, when the trajectory of the needle point is changed from that of FIG. 10 embodiment (a) to that of FIG. 10 embodiment (b), that is, when the trajectory of the needle point is made closer (spread) to the sine curve, the length of the crank rod 3 have to be extended. Accordingly, the length of the crank rod 3 in FIG. 10 embodiment (b) is required to be two times longer than that in FIG. 10 embodiment (a), extremely increasing the size of the sewing machine (h2>>h1).

However, it does not mean that simply making the trajectory of the needle point closer to the sine curve is appropriate. The sewing machines have the fabric feeding mechanism that feeds the fabric to the next stitch forming position after the fabric is stitched. As the above described stitch forming cycle, the needle is risen and pulled out from the fabric, and consequently the fabric is moved in the predetermined amount by the unillustrated fabric feeding mechanism installed under the needle plate. If the fabric is moved while the needle is still piercing the fabric, the needle may break or other accidents may be caused. Therefore, the feeding of the fabric must be started after the needle is pulled out from the fabric, and must be completed before the needle is pierced to the fabric to form the next stitch.

Accordingly, making the trajectory of the needle point closer (spread) to the sine curve means that a time the needle is piercing the fabric is increased in the stitch forming cycle, and as a result, from the viewpoint of feeding the fabric, there is a disadvantage that a time for feeding the fabric is decreased. This is not preferable especially for the sewing machine with a long fabric feeding stroke. For such sewing machine or a method implementing the same, there is a demand of rather decreasing the time the needle is piercing the fabric in the stitch forming cycle to relatively increase the time for fabric feeding.

Thus, there are various characteristics for the trajectory of the needle point according to types of the sewing machine or stitching methods, but the conventional technology cannot cope with all the requirement due to the mechanical limitation.

SUMMARY OF THE INVENTION

To address the aforementioned problems, for example, a needle bar driving mechanism according to Patent Document 1 is suggested. Patent Document 1 does not utilize the slider crank mechanism, and instead utilizes an internal gear and an eccentric cam to convert the rotation motion of the upper shaft to the linear reciprocation motion of the needle bar. The trajectory of the needle point becomes the sine curve by the internal gear and a rotating body, and can further be altered by changing the shape of the eccentric cam.

However, compared with the slider crank mechanism, a mechanism of the internal gear and the eccentric cam may be able to spread the trajectory of the needle point, but is difficult to thin the trajectory. In addition, the eccentric cam may be another vibration source. Furthermore, since the internal gear is a unique part, the sewing machine utilizing the same is expensive in cost, and the mechanism thereof has a large size. The aforementioned problems are not addressed.

The present disclosure is suggested to address the aforementioned problems, and the objective is to provide a sewing machine that can set the trajectory of the needle point suitable for various types of sewing machines and stitching method without a large-sizing of a driving mechanism and a drastic change in the configuration thereof.

A sewing machine according to the present disclosure includes following structures.

(1) A needle bar supported by a needle bar supporter in a manner freely movable up and down relative to a frame.

(2) An upper shaft supported in the direction horizontal to the frame, and rotated by a motor.

(3) A crank fixed to the upper shaft, and having an output end which circulates.

(4) A crank rod having an input end connected to the output end of the crank in a freely rotatable manner.

(5) A slider provided to an output end of the crank rod in a manner freely movable up and down relative to the frame.

(6) A connection rod having an input end connected to an intermediate portion between the input end of the crank rod and the output end of the crank rod in a freely rotatable manner, and an output end connected to the needle bar in a freely rotatable manner.

(7) A length of the needle bar and a length from connecting position of the connection rod and the crank rod to the slider differ.

The present disclosure may have the following structures.

(1) The length of the connection rod is longer than the length from connecting position of the connection rod and the crank rod to the slider.

(2) The length of the connection rod is shorter than the length from connecting position of the connection rod and the crank rod to the slider.

(3) The needle bar is supported by the needle bar supporter fixed to the frame in a manner freely movable up and down.

(4) A swinging rod moving the needle bar supporter between a right needle dropping position and a left needle dropping position is provided.

(5) A supporting shaft is provided to the frame in the vertical direction, and the needle bar supporter rotates in the horizontal direction by the swinging rod with the supporting shaft as a center.

(6) The supporting shaft is provided to the frame in the horizontal direction, and the needle bar supporter rotates in the vertical direction by the swinging rod with the supporting shaft as a center.

(7) A guide bar supporting the slider in a manner freely movable up and down is a bar-shaped component provided vertically to the frame.

(8) The guide bar supporting the slider in a manner freely movable up and down is the needle bar.

According to the present disclosure, the sewing machine can make the trajectory of the needle point closer to the sine curve compared to the conventional technology. As a result, a sewing machine with less vibration and a sewing machine capable of a broad zigzag sewing can be provided. In addition, according to the present disclosure, the sewing machine can draw the trajectory of the needle point that is a curve in a steep angle at a region near the bottom dead center, and a curve in a gentle angle at a region near the top dead center. As a result, the sewing machine having a feed dog with a long moving stroke can be provided. Furthermore, the present disclosure can install aforementioned mechanisms without increasing a size of the conventional sewing machines.

DETAILED DESCRIPTION OF THE EMBODIMENTS

Figure 1:
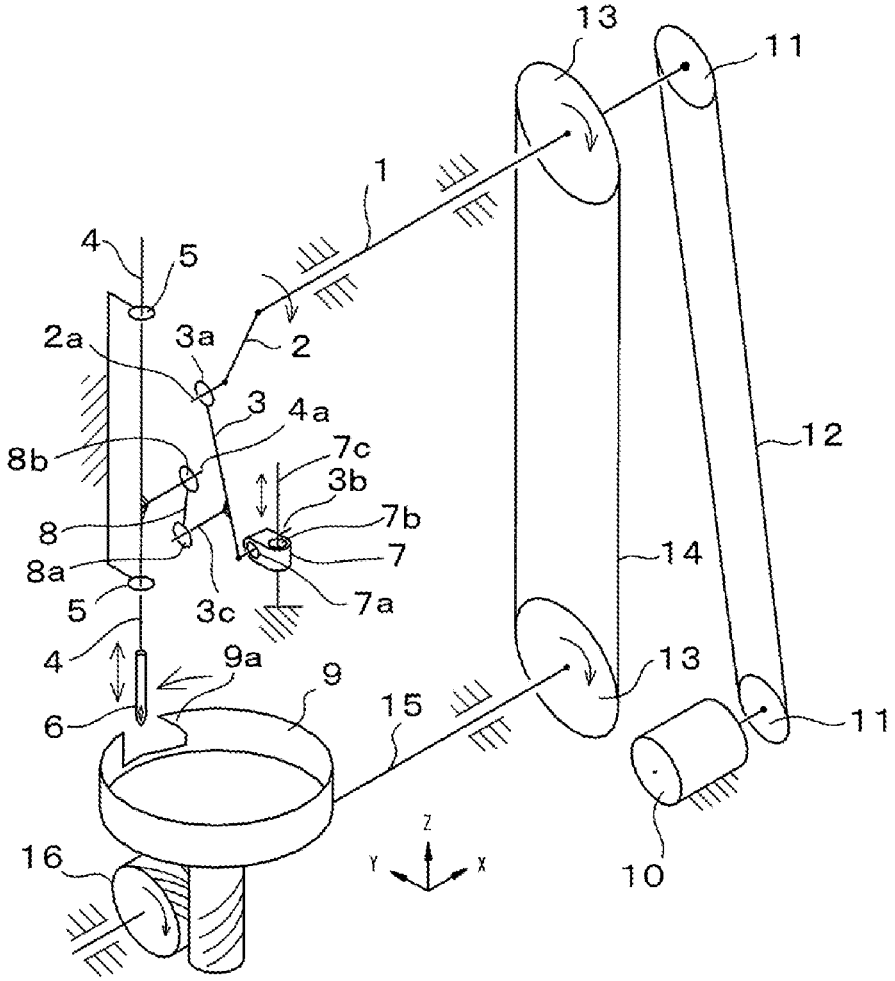
FIG. 1 is a perspective view illustrating a framework of a driving mechanism of a sewing machine according to a first embodiment.

An embodiment of the present disclosure will be described. In the embodiment, a perpendicular direction that is a frontward and backward direction is a fabric feeding direction (Y-direction in figures), a lateral direction that is a rightward and leftward direction is a direction orthogonal to the fabric feeding direction (X-direction in figures), and a vertical direction that is an upward and downward direction is a direction a needle pierces the fabric (Z-direction in figure). In addition, as for same components in the conventional technology illustrated in FIG. 8, the same reference numerals are used, and the description thereof will be omitted.

1. First Embodiment

(1) Brief Description

FIG. 1 is a perspective view illustrating a driving mechanism of a sewing machine according to the first embodiment. The sewing machine according to the first embodiment includes a needle plate supported by a frame (unillustrated), and a fabric placed on the needle plate is moved in the perpendicular direction (Y-direction) for sewing. An upper shaft 1 extending in the lateral direction in parallel with a surface of the needle plate is provided above the needle plate. The upper shaft 1 is rotated in the arrow direction in the figure by a motor 10 via a pulley 11 fixed to an input end of the upper shaft 1, and via a belt 12. A crank 2 is fixed to an output end of the upper shaft 1.

An input end of a crank rod 3 is connected in a freely rotatable manner to an output end of the crank 2 via a shaft 2*a* extending in parallel with the upper shaft 1, and via a shaft hole 3*a*. A slider 7 is connected to an output end of the crank rod 3 and guides the output end of the crank rod 3 in the vertical direction. A shaft hole 7*a* extending in the horizontal direction is provided to the slider 7, and a shaft 3*b* fixed to the output end of the crank rod 3 is inserted to the shaft hole 7*a* in a freely rotatable manner. A shaft hole 7*b* extending in the vertical direction is provided to the slider 7, a guide bar 7*c* extending in the vertical direction is inserted to the shaft hole 7*b* in a freely slidable manner. The guide bar 7*c* is fixed to the frame portion of the sewing machine (unillustrated), and when the crank rod 3 moves, the slider 7 moves up and down, together with the output end of the crank rod 3, along the guide bar 7*c*.

An input end of a connection rod 8 is connected to an intermediate portion of the crank rod 3. That is, a shaft hole 8*a* is provided to the input end (a lower end in FIG. 1) of the connection rod 8, and a shaft 3*c* extending in the horizontal direction and fixed to the intermediate portion of the crank rod 3 is inserted to a shaft hole 8*a* in a freely rotatable manner. A shaft hole 8*b* is provide to an output end (an upper end in FIG. 1) of the connection rod 8, and a shaft 4*a* fixed to a needle bar 4 in the horizontal direction is inserted to the shaft hole 8*b* in a freely rotatable manner.

A shuttle 9 having a point 9*a* is provided under the needle 6. The shuttle 9 rotates in the horizontal direction with a shaft 9*b* extending in the vertical direction as a center. As a driving source of the shuttle 9, a worm drive mechanism 16 is provided to an output end of a lower shaft 15, and transmits a rotation power of the upper shaft 1 rotated by the motor 10 to the lower shaft 15 via a pulley 13 and a belt 14.

(2) A Relation Between the Crank Rod 3 and the Connection Rod 8

Figure 2:
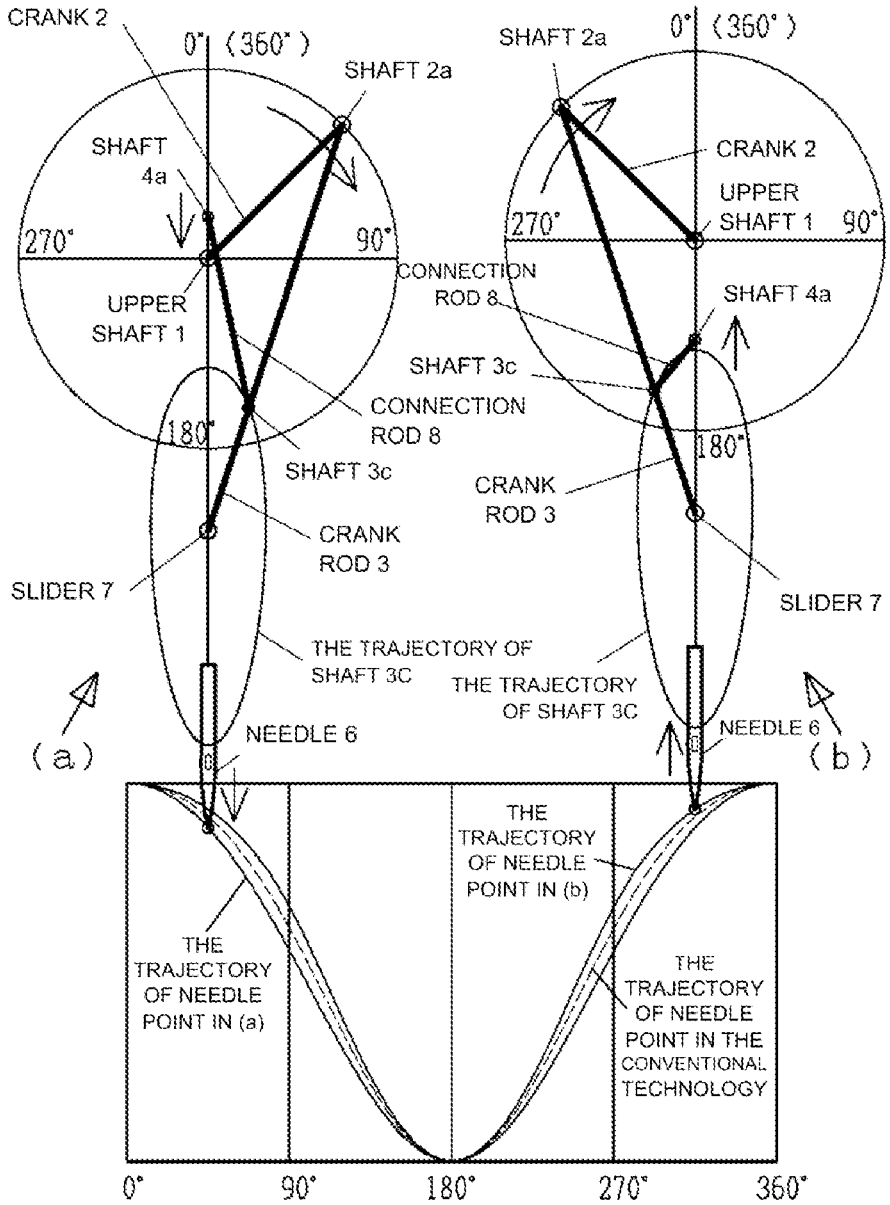
FIG. 2 embodiment (a) is a diagram illustrating a crank, a crank rod, a connection rod, and a movement of a needle in the case the connection rod is long, FIG. 2 embodiment (b) is a diagram illustrating a crank, a crank rod, a connection rod, and a movement of a needle in the case the connection rod is short, and FIG. 2 embodiment (c) is a diagram illustrating a trajectory of a needle point, all according to the first embodiment.

FIG. 2 embodiment (a) is a structure model in a case the trajectory of the needle point is spread from the conventional technology, FIG. 2 embodiment (b) is a structure model in a case the trajectory of the needle point is thinned from the conventional technology, and FIG. 2 embodiment (c) is diagram illustrating the trajectories of the needle point obtained by the structures of in FIG. 2 embodiment (a), FIG. 2 embodiment (b), and the conventional technology. It should be noted that the needle bar 4 which fixes the needle 6 and transmits the movement of the shaft 4*a* to the needle 6 is omitted in the figures.

In the first embodiment, a length of the crank 2, a length of the crank rod 3, and a stroke of the needle 6 that is a distance between a top dead center and a bottom dead center are equivalent to the conventional technology. In addition, a position of the shaft 4*a* which connects the needle bar 4 and the connection rod 8 is determined by changing a length of the connection rod 8 while maintaining a position of the shaft 3*c* which connects the crank rod 3 and the connection rod 8. As will be explained later, since the length of the connection rod 8 affects the trajectory of the needle point, a needle bar driving mechanism that has the trajectory spread or thinned from the trajectory of the conventional technology illustrated by the dotted line in FIG. 2 embodiment (c) can be provided by changing the length of the connection rod 8.

(2-1) In a Case the Trajectory is Equivalent to the Conventional Technology (the Dotted Line in FIG. 2 Embodiment (c))

Figure 8:
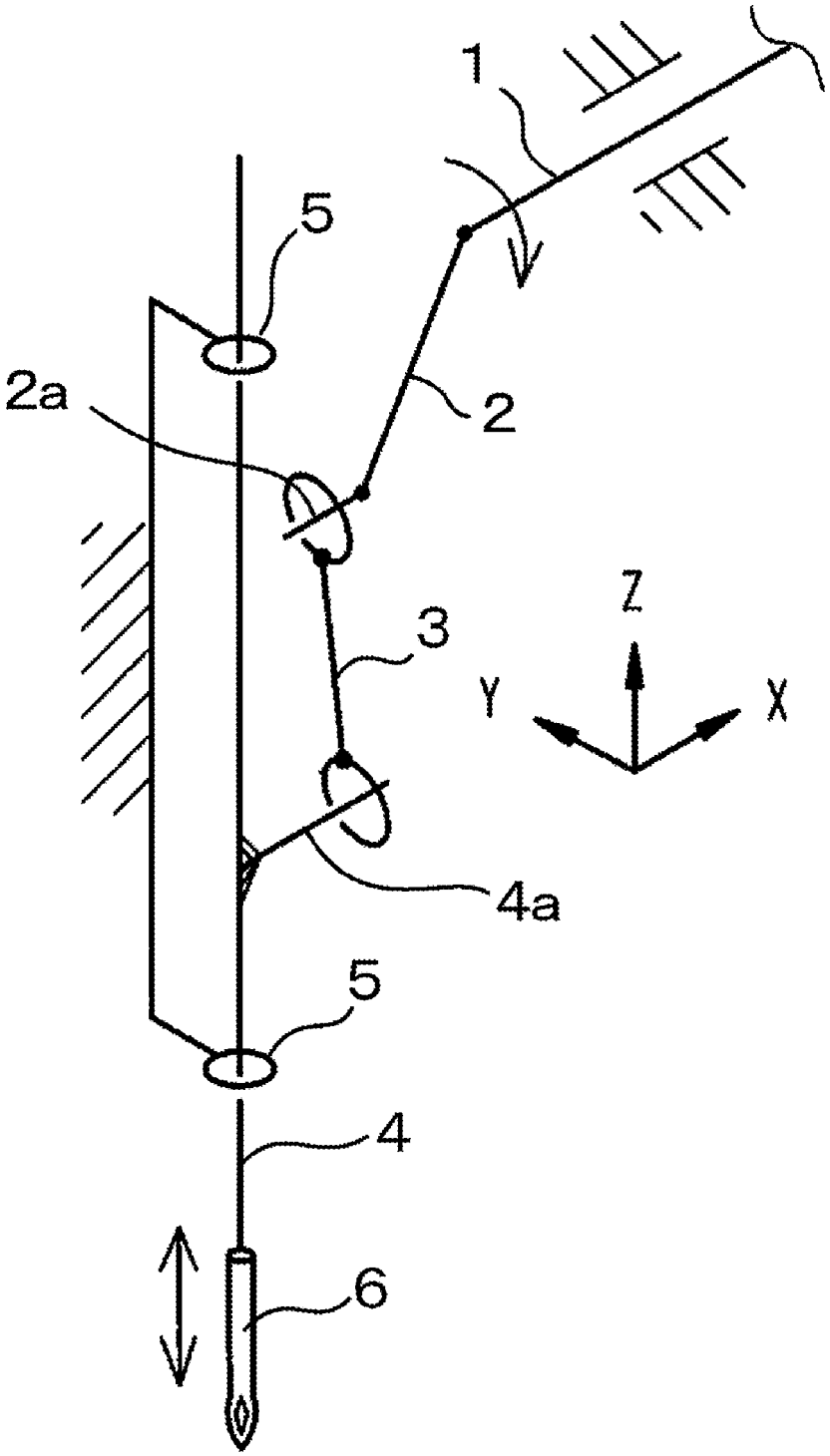
FIG. 8 is a perspective view illustrating a framework of a driving mechanism of a conventional sewing machine.

A trajectory indicated by the dotted line in FIG. 2 embodiment (c) is equivalent to a trajectory of the needlepoint of the conventional technology that includes the crank 2 and the crank rod 3 as illustrated in FIG. 8. That is, when it is assumed that, in the first embodiment illustrated in FIG. 2, the slider 7 is connected to the unillustrated needle bar 4 and the movement of the slider 7 is transmitted to the needle 6, the same trajectory as the conventional technology can be obtained.

However, as illustrated in FIG. 2, the shaft 4*a* is connected to the output end of the connection rod 8, and drives the unillustrated needle bar 4. In addition, the input end of the connection rod 8 is connected to the shaft 3*c* provided to the intermediate portion of the crank rod 3, and the output end of the crank rod 3 is connected to the slider 7 which moves in the vertical direction. Therefore, when the shaft 2*a* connected to the crank rod 3 rotates, the crank rod 3 moves up and down more vertically at the portion nearer to the slider 7, and rotates more circularly at the portion nearer to the shaft 2*a*. Accordingly, the shaft 3*c* which is connected to the intermediate portion of the crank rod 3 and to the input end of the connection rod 8 draws a trajectory of a vertical ellipse as illustrated in FIG. 2 embodiment (a).

In this case, with reference the rotation angle of the upper shaft 1, the stroke from the top dead center to the bottom dead center of the shaft 2*a* drawing a perfect circle and the stroke from the top dead center to the bottom dead center of the axis 3*c* drawing an ellipse are consistent. In detail, the length of the crank 2 is La, the length of the crank rod 3 is Lb, a length from the output end of the crank rod 3 to the shaft 3*c* is Lc, a length of the connection rod 8 is Ld, and a major axis of the ellipse is 2×La.

When the length Ld is equal to the length Lc, a trajectory of the slider 7 positioned at the output end of the crank rod 3, that is, a trajectory of the output end of the crank rod 3 is the same as the trajectory of the needle point in the conventional technology as illustrated by the dotted line of the FIG. 2 embodiment (c). When the length Ld is equal to the length Lc, since the shaft 4*a* and the slider 7 changes the distance therebetween, but maintains the isosceles triangle shape that has the shaft 3*c* as an apex while the shaft 3*c* moves on the trajectory of the ellipse, the shaft 4*a* and the slider 7 moves up and down simultaneously via shaft 3*c*.

Since the trajectory of the slider 7 is equal to the trajectory of the needle bar 4 in the conventional technology which does not have the connection rod 8, when the length Ld is equal to the length Lc, the trajectory of the needle point according to this embodiment is the same as the trajectory in the conventional technology.

Figure 3:
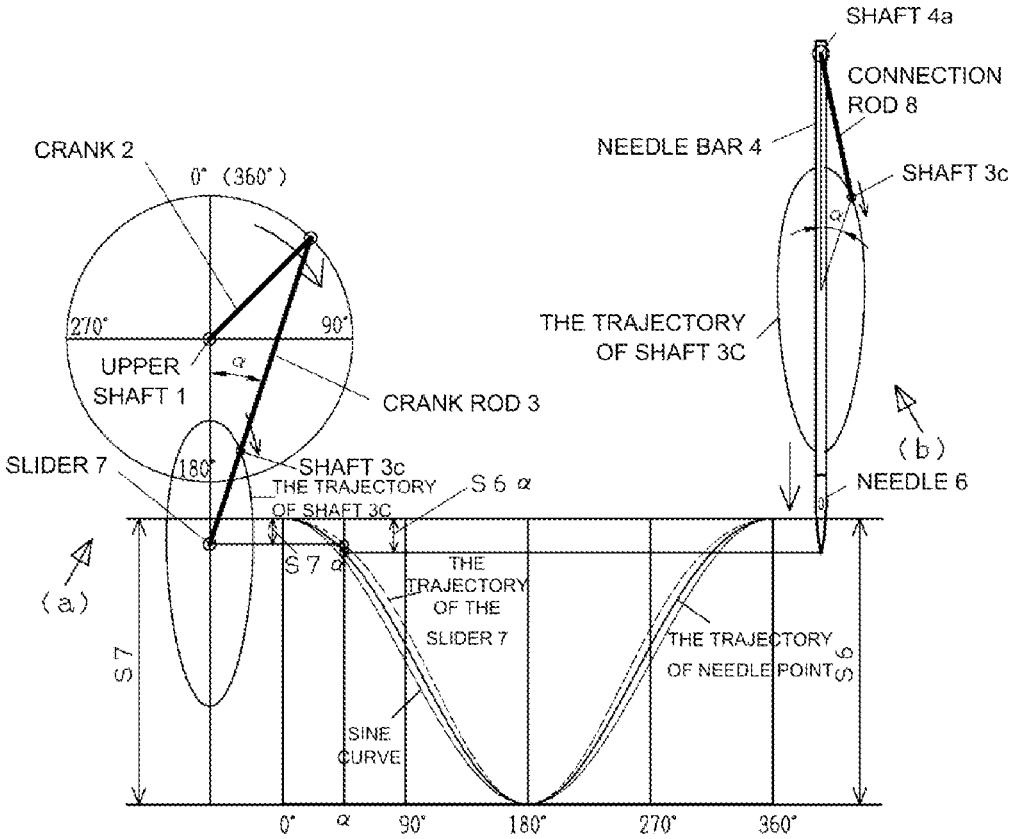
FIG. 3 is diagram illustrating the movement of the crank rod and the connection rod separately, and FIG. 3 embodiment (a) is a diagram illustrating a movement of the crank rod in FIG. 2 embodiment (a), FIG. 3 embodiment (b) is a diagram illustrating a movement of the connection rod, a needle bar, and the needle in FIG. 2 embodiment (a), and FIG. 3 embodiment (c) is a diagram illustrating a slider and the trajectory of the needle point provided to the crank rod.

(2-2) In a Case of Spreading the Trajectory (FIG. 2 Embodiment (a) and FIG. 3)

In the first embodiment, FIG. 3 explains a case of FIG. 2 embodiment (a) which the trajectory is spread. FIG. 3 embodiment (a) illustrates movement of the crank 2 and the crank rod 3, FIG. 3 embodiment (b) illustrates movement of the connection rod 8, the needle bar 4, and the needle 6, and FIG. 3 embodiment (c) illustrates the trajectory of the needle point. In FIG. 3 embodiment (c), S7 is a stroke of the slider 7 from the top dead center to the bottom dead center, and S6 is a stroke of the shaft 4*a* from the top dead center to the bottom dead center. A stroke amount of S6 and S7 is equivalent, and FIG. 3 embodiment (a) and FIG. 3 embodiment (b) is illustrated so that their strokes overlaps in FIG. 3 embodiment (c) for easy comparison.

To spread the trajectory, the length Ld is set to be longer than the length Lc. That is, the lengths are set to be Ld>Lc as illustrated in FIG. 2 embodiment (a). Accordingly, as illustrated in FIG. 3 embodiment (a), when the crank rod 3 rotates by an angle α by the rotation of the upper shaft 1, the slider 7 descends from the top dead center by S7α and the needle 6 (that is the shaft 4*a*) descends from the top dead center by S6α. Since a descending amount S7α of the slider 7 is smaller than a descending amount S6*a* of the needle 6, the trajectory of the needle point is drawn at the position lower than the trajectory of the slider 7, that is, the trajectory of the needle point is more spread from the trajectory of the slider 7. A difference between the descending amount S7α and the descending amount S6α increases until the upper shaft 1 rotates 90°, and since the moving amount of the slider 7 per angle increases, the difference between the descending amount S7*a* and the descending amount S6α decreases when the rotation angle exceeds 90° until the upper shaft 1 rotates 180° where the two trajectories are consistent at the bottom dead center.

Since the moving amount of the slider 7 per angle is big, at the same rotation angle of when the upper shaft 1 rotates from 180° to 270°, the ascending amount of the slider 7 from the bottom dead center is larger than the ascending amount of the needle 6 (that is the shaft 4*a*) from the bottom dead center. As a result, the trajectory of the needle point is drawn at the position lower than the trajectory of the slider 7, that is, the trajectory of the needle point is more spread from the trajectory of the slider 7. Since the moving amount of the slider 7 per angle decreases, the difference between the ascending amount of the slider 7 and the ascending amount of the needle 6 decreases when the rotation angle exceeds 270° until the upper shaft 1 rotates 360° where the two trajectories are consistent at the top dead center.

By the above configuration according to the first embodiment, the trajectory of the needle point can be spread without changing the distance between the upper shaft 1 and the bottom dead center of the crank rod 3. As a result, the trajectory of the needle point can be near the sine curve without the large-sizing of the mechanism due to the extended long crank rod 3, and the imbalance of the acceleration of the needle near the top dead center and the acceleration of the needle near the bottom dead center can be addressed. Thus, a sewing machine with sure formation of the stitch and with little vibration when operated rapidly can be provided.

Figure 4:
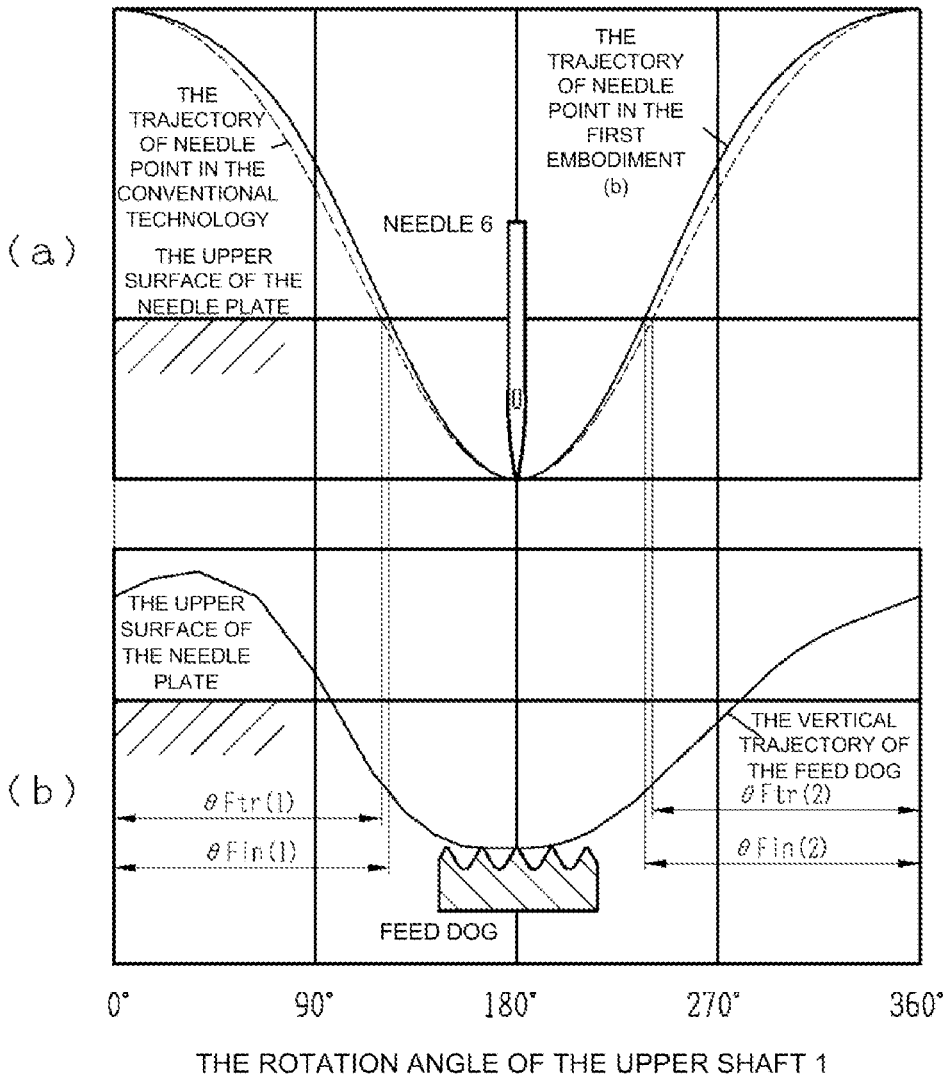
FIG. 4 embodiment (a) is diagram illustrating the trajectory of the needle point when a length of the connection rod is short, and FIG. 4 embodiment (b) is a trajectory of a feed dog when a length of the connection rod is short.

(2-3) In a Case the Trajectory is Thinned (FIG. 2 Embodiment (b) and FIG. 4)

To thin the trajectory, the length Ld is set to be shorter than the length Lc. That is the length are set to be Ld<Lc as illustrated in FIG. 2 embodiment (b). Accordingly, the trajectory of the needle point is drawn inside the trajectory of the conventional technology, that is, the trajectory of the needle point at the bottom dead center is more thinned from the trajectory of the conventional technology.

On the other hand, as described above, a movable range of the feed dog is a range in which the needle point is pulled out from the fabric and is positioned above the needle plate. Therefore, as illustrated in FIG. 4, a fabric feeding range of the feed dog according to the first embodiment is θFin(1)+θFin(2) while a fabric feeding range of the feed dog according to the conventional technology is θFtr(1)+θFtr(2). The movable range of the feed dog according to the first embodiment can be enlarged while maintaining the stroke of the needle point from the top dead center to the bottom dead center and an angular velocity of the upper shaft 1. As a result, a sewing machine that can perform various operation by increasing a fabric feeding amount and increasing the fabric moving time.

Second Embodiment

A second embodiment is explained with reference to FIG. 5 and FIG. 6. In the second embodiment, the same components as those of the first embodiment are referenced by the same numerals and the explanation thereof is omitted. The second embodiment is applied to a zigzag sewing machine. In particular, as illustrated in FIG. 2 embodiment (a) and FIG. 3, the trajectory of the needle point is spread from the conventional technology by setting the length Ld, which is a length of the connection rod 8, longer than the length Lc, which is a length from slider 7 that is the output end of the crank rod 3 to the shaft 3*c* (Ld>Lc).

Figure 5:
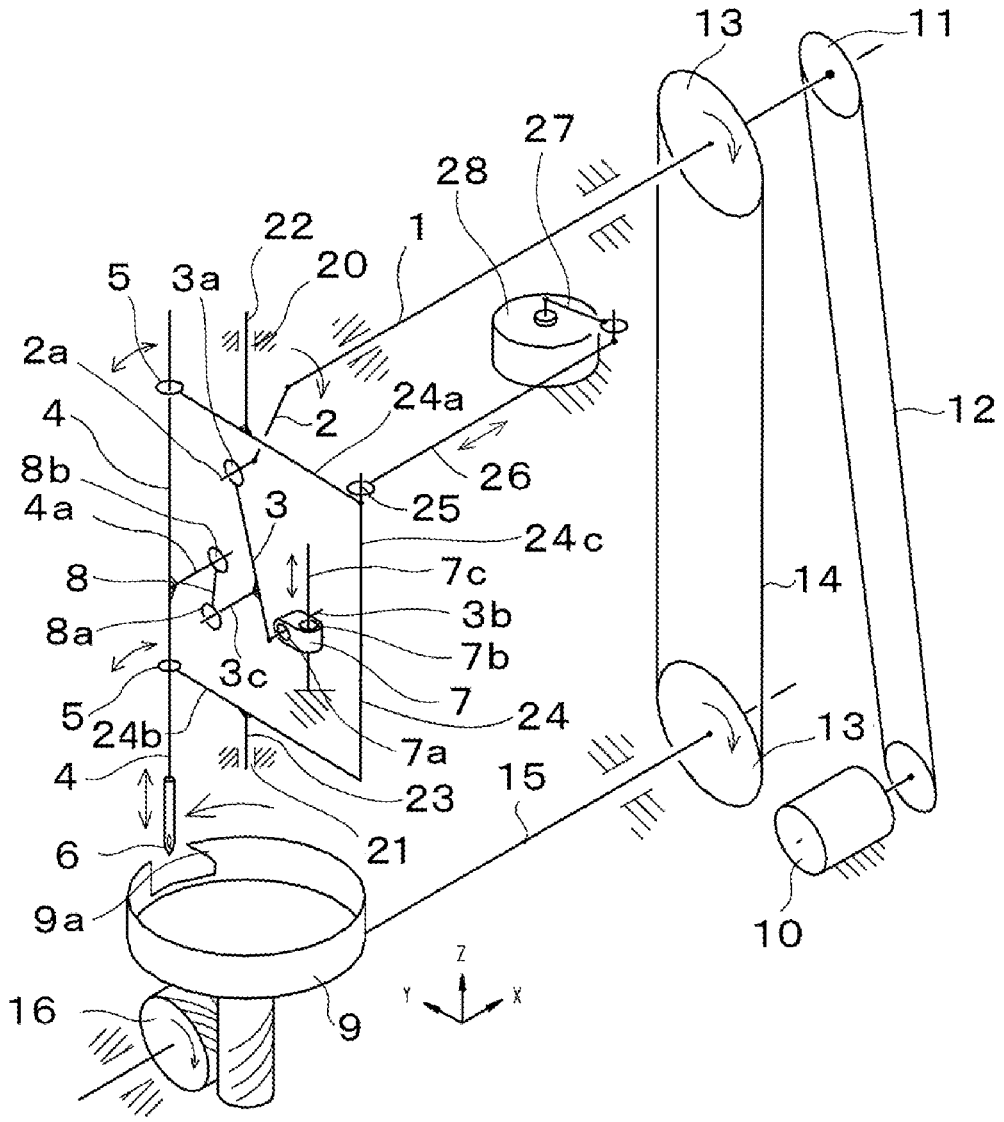
FIG. 5 is a perspective view illustrating a framework of a driving mechanism of a sewing machine according to a second embodiment.

As illustrated in FIG. 5, an upper supporting shaft 22 and a lower supporting shaft 23 extended in parallel with the needle bar 4 are rotatably supported by an upper bearing 20 and a lower bearing 21 provided to the frame of the sewing machine, respectively. A needle bar supporter 24 is supported by the upper supporting shaft 22 and the lower supporting shaft 23 in a way that the needle bar supporter 24 is freely rotatable with the upper supporting shaft 22 and the lower supporting shaft 23 as a center. The needle bar supporter 24 is formed by connecting three components of an upper arm 24*a* and a lower arm 24*b* extending in the perpendicular direction, and a perpendicular arm 24*c* extending in parallel with the needle bar 4 in a frame shape. A lower end of the upper supporting shaft 22 is fixed to an intermediate portion of the upper arm 24*a*, and an upper end of the lower supporting shaft 23 is fixed to an intermediate portion of the lower arm 24*b*.

Lifting guides 5 are each provided to the ends of the upper arm 24*a* and the lower arm 24*b* opposite to the perpendicular arm 24*c*. The lifting guides 5 are components that guide the needle bar 4 to move in the vertical direction. In addition, the lifting guides 5 enable the upper arm 24*a* and the lower arm 24*b* to rotate around the needle bar 4 when the needle bar supporter 24 rotates.

A shaft 25 is provided to an upper end of the perpendicular arm 24*c*, and an output end of a swinging rod 26 is connected to the shaft 25 in a freely rotatable manner. An input end of the swinging rod 26 is connected to an end of an oscillating link 27 rotated by a motor 28 for oscillation.

In the second embodiment employing the above structure, when the oscillating link 27 moves in the lateral direction (X-direction in figures), the needle bar supporter 24 rotates with the upper supporting shaft 22 and the lower supporting shaft 23 as a center. When the needle bar supporter 24 rotates, the needle bar 4 supported by the output ends of the upper arm 24*a* and the lower arm 24*b* moves in the lateral direction. As a result, when the needle bar 4 moves up and down by the rotation of the upper shaft 1, the needle dropping position varies in the lateral direction depending on the position of the needle bar 4 oscillated by the needle bar supporter 24.

Figure 6:
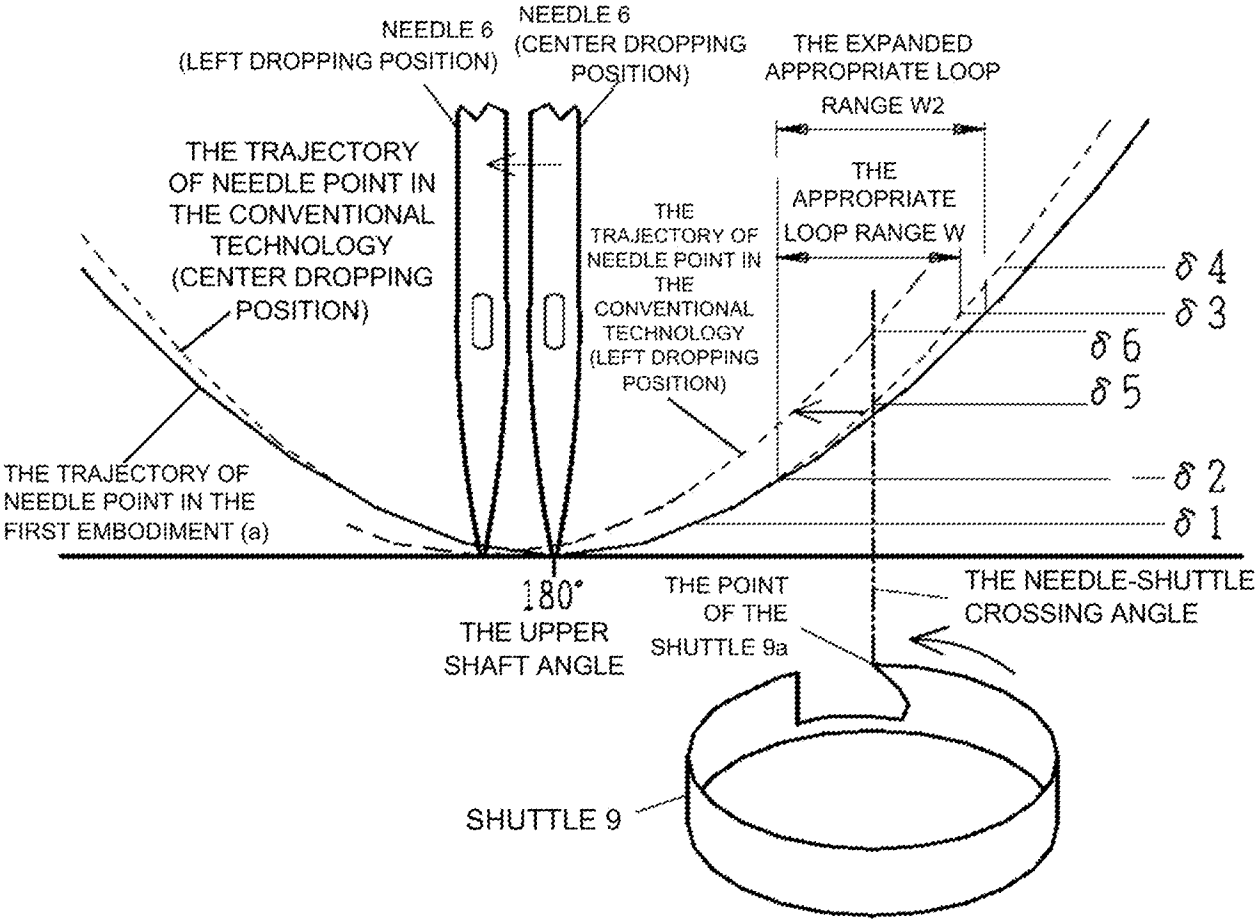
FIG. 6 is an enlarged diagram illustrating a trajectory of a needle point when an angle of an upper shaft is near 180° in a case a length of a connection rod is long according to the second embodiment.

FIG. 6 is a schematic diagram illustrating the enlarged trajectory of the needlepoint (the spread trajectory) near the bottom dead center according to the second embodiment, and a relation between the shuttle 9 and a needle-shuttle crossing angle which the needle 6 and a point 9*a* of the shuttle 9 intersect. As illustrated in FIG. 5, the sewing machine according to the second embodiment have different right needle dropping position and left needle dropping position by fixing a position of the shuttle 9 and moving the needle 6 in the lateral direction. FIG. 6 illustrates a relative relation of the positions of the needle 6 and the shuttle 9 in a case the needle 6 is at the center position (center needle dropping position) and in a case the needle 6 is at the left position (left needle dropping position).

Figure 9:
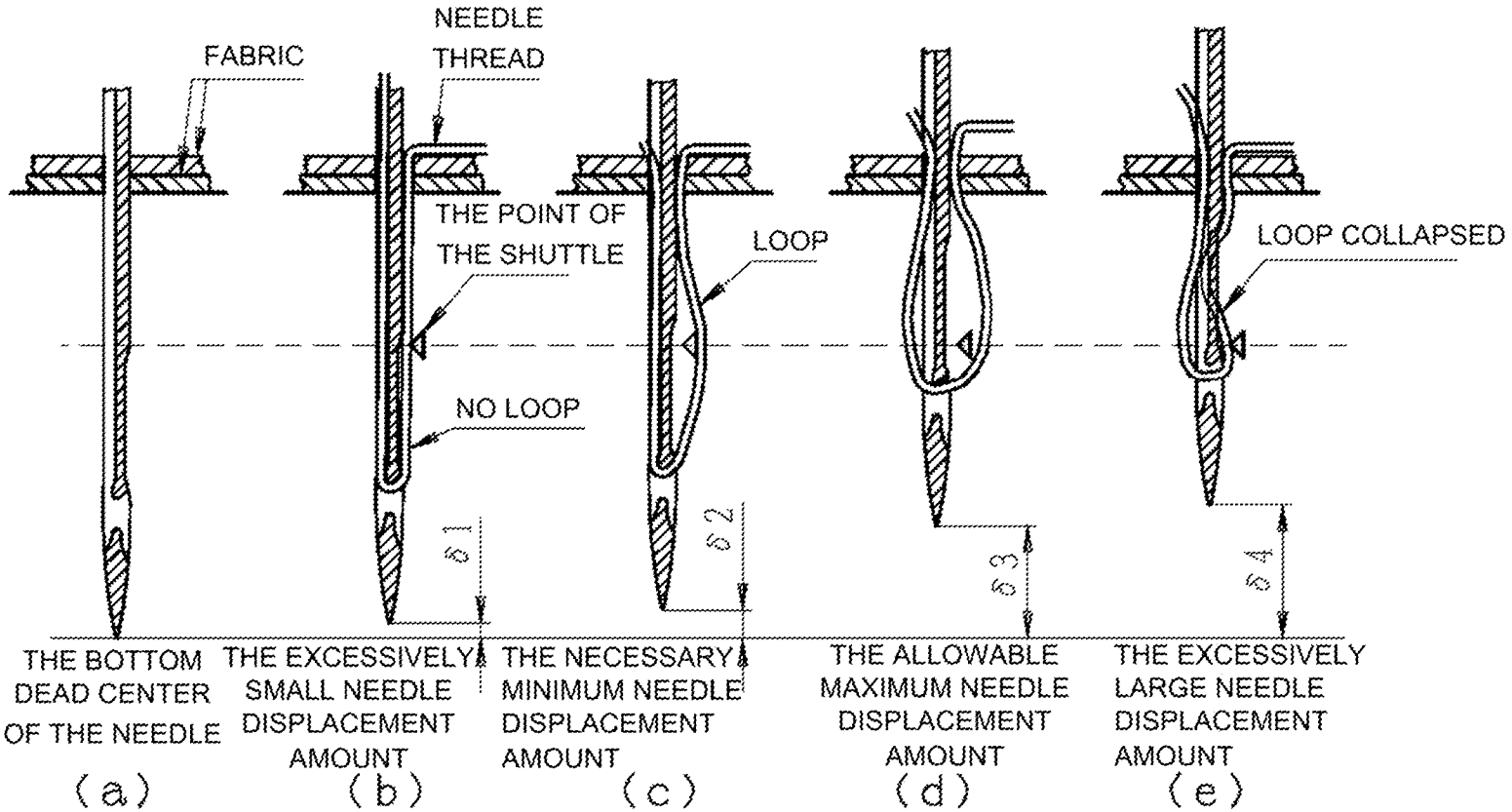
FIG. 9 is a diagram illustrating a relation between a needle rising amount from a bottom dead center and a loop.
Figure 10:
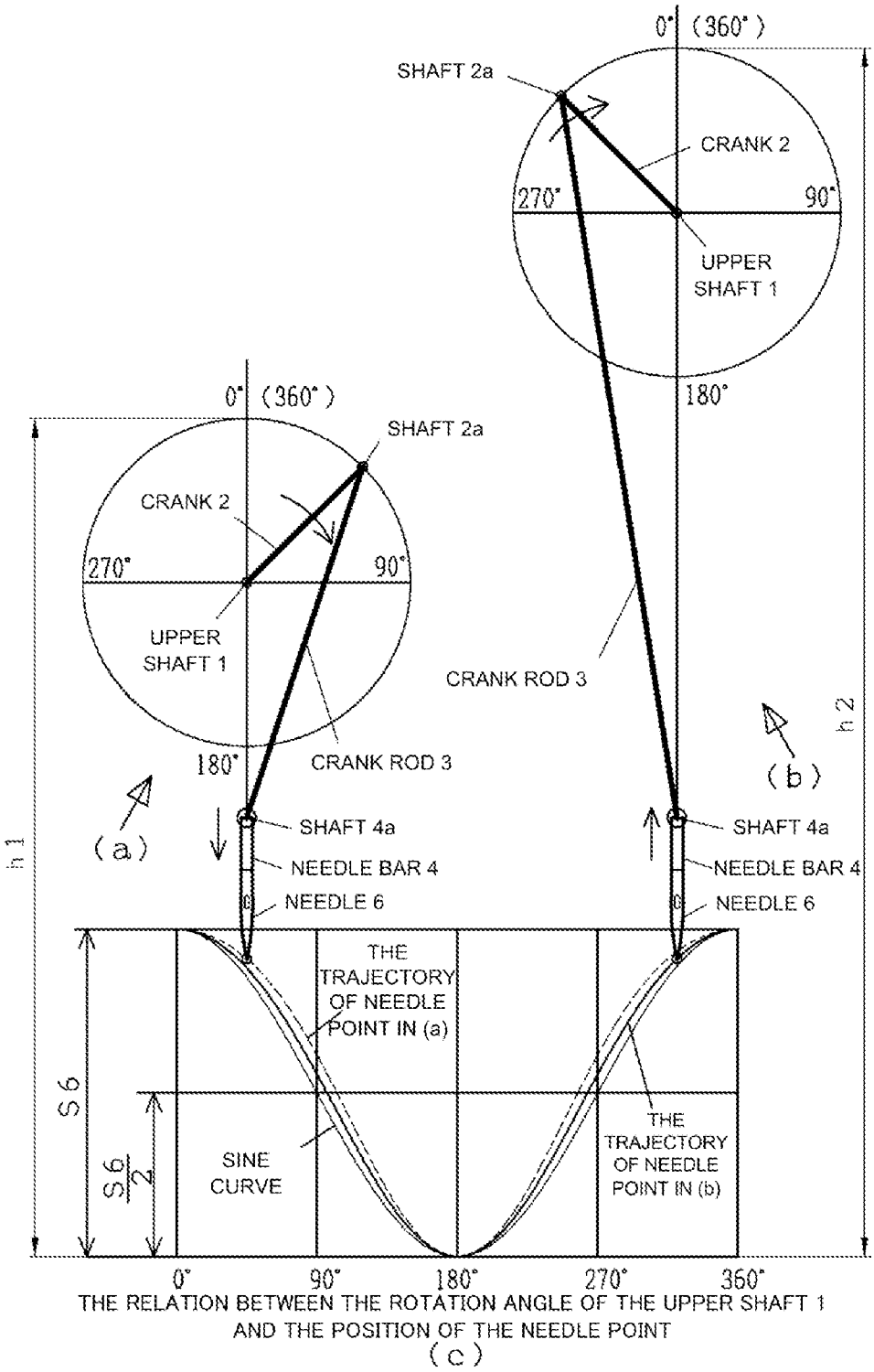
FIG. 10 is a diagram illustrating a trajectory of a needle point, and an example configuration to spread the trajectory of the needle point in the conventional technology.

As explained in FIG. 9, in order to ensure that the point of the shuttle 9 passes through a loop, a needle displacement amount at a timing the needle 6 and the shuttle 9 intersects, that is, at the needle-shuttle crossing angle have to be within δ2 to δ3. Here, affection to the needle displacement amount when the needle dropping position changes by zig-zag mechanism is explained by using the trajectory of the needle point according to the conventional technology. A needle displacement amount at the needle-shuttle crossing angle when the needle 6 is at the center position is δ5. When the needle 6 moves to the left needle dropping position by operations of the motor 28 for oscillation and the swinging rod 26, since the position of the needle 6 changes while the position of the shuttle 9 does not change, the trajectory of the needle point moves in parallel with the shuttle 9. Therefore, when the needle 6 and the shuttle 9 reaches the needle-shuttle crossing angle in the above state, the needle displacement amount changes to δ6 because the relative position changes. Since it is δ6>δ5, if the needle displacement amount increases furthermore, the needle displacement amount might exceed an allowable maximum needle displacement amount (δ3).

On the other hand, although unillustrated, when the needle 6 is moves to the right needle dropping position from the center needle dropping position, the needle displacement amount decreases due to the same reason above. Therefore, an oscillation width of the needle 6 (a zig-zag swinging amount) is a width corresponding to an appropriate loop range W that is within a necessary minimum needle displacement amount (δ2) and the allowable maximum needle displacement amount (δ3).

Since an inclination of the trajectory of the needle point near the bottom dead center according to the second embodiment is more gentle than the conventional technology, a change in the needle displacement amount relative to a change amount of an upper shaft angle is smaller. Therefore, a range of the upper shaft angle, that is, the appropriate loop range W within the necessary minimum needle displacement amount (δ2) and the allowable maximum needle displacement amount (δ3) is enlarged from the conventional technology. Accordingly, since the appropriate loop range W that limits the zig-zag swinging amount is enlarged (W2), the zig-zag sewing machine with a broader zig-zag stitching compared to the conventional technology can be provided.

3. Third Embodiment

Figure 7:
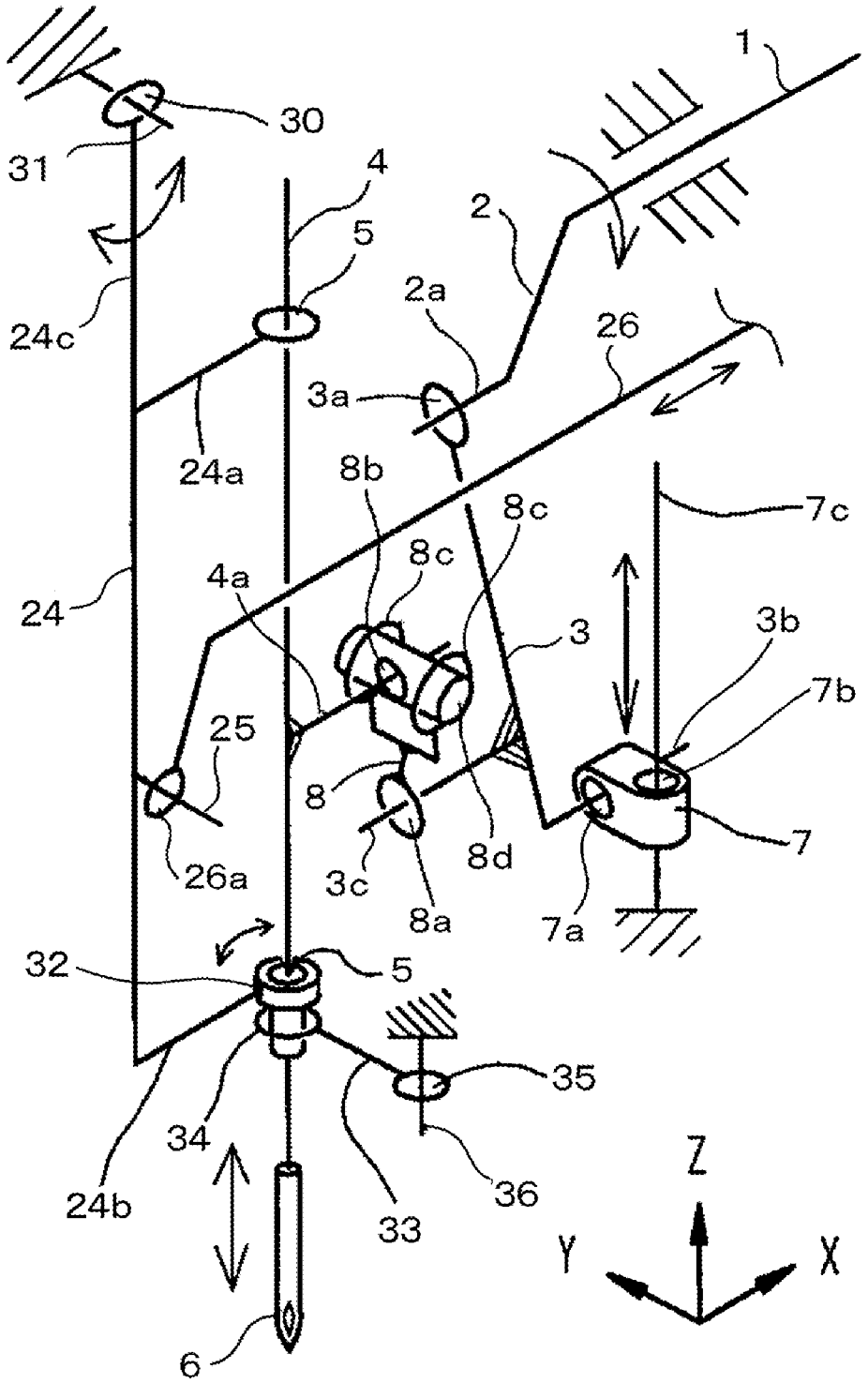
FIG. 7 is a perspective view illustrating a framework of a driving mechanism of a sewing machine according to a third embodiment.

A third embodiment is explained by FIG. 7. The third embodiment is employed in the zig-zag sewing machine like the second embodiment. The third embodiment moves the needlepoint in the pendulum-like motion by supporting in the a freely rotatable manner a bearing 30 provided to an upper end of the perpendicular arm 24*c* of the needle bar supporter 24 by a supporting shaft 31 fixed horizontally to the frame of the sewing machine instead of rotating the needle bar 4 in the lateral direction by oscillation like the second embodiment.

The lifting guide 5 is provided to an end of the upper arm 24*a*, and guides an upper portion of the needle bar 4. A bush 32 is provided to an end of the lower arm 24*b*, and an inside of the bush 32 is the lifting guide 5 and guides a lower portion of the needle bar 4. A bearing 34 at a first end of a guiding link 33 is provided to an outer circumference of the bush 32 in a freely rotatable manner. A bearing 35 at a second end of the guiding link 33 is connected a supporting shaft 36 fixed to the frame of the sewing machine in a freely rotatable manner. The shaft 25 is fixed to the intermediate portion of the perpendicular frame 24*c*, and a bearing 26*a* provided to the output end of the swinging rod 26 is connected to the shaft 25 in a freely rotatable manner.

In the third embodiment, the needle bar 4 and the crank rod 3 is connected via the connection rod 8. However, to absorb the swinging motion of the needle bar 4, the structure of the connecting portion of the connection rod 8 and the shaft 4*a* of the needle bar 4 is different from the second embodiment. Namely, the output end of the connection rod 8 is branched into two ends, and a pair of bearings 8*c* is provided to the two ends. A guiding shaft 8*d* is supported by the bearings 8*c* in a freely rotatable manner, and the shaft 4*a* of the needle bar 4 is inserted to a shaft hole 8*b* provided to the guiding shaft 8*d* in a freely slidable manner.

In the third embodiment employing the above structure, when the perpendicular arm 24*c* moves in the lateral direction by the reciprocation of the swinging rod 26, the needle bar supporter 24 moves in the pendulum motion with the shaft 31 as a center and a lower portion of the needle bar supporter 24 is guided by the guiding link 33 and moves in circular motion. As a result, the needle bar 4 supported by the needle bar supporter 24 also rotates in the lateral direction, and the needle 6 at the end of the needle bar 4 moves up and down at the right needle dropping position and the left needle dropping position.

In addition, in the third embodiment employing the above structure, the trajectory of the needle point can be spread by moving the needle bar 4 up and down by the connection rod 8. As a result, a change amount of the needle displacement amount at the right and left needle dropping position decreases, and the zig-zag sewing machine with a broader zig-zag stitching compared to the conventional technology can be provided.

Other Embodiments

Embodiments of the present disclosure have been described above, and various omissions, replacements, and modifications can be made thereto without departing from the scope of the present disclosure. Such embodiments and modifications are within the scope of the present disclosure, and are also within the scope of the invention as recited in the appended claims and the equivalent range thereof. For example, other embodiments include the descriptions below.

(1) The length La of the crank 2, the length Lb of the crank rod 3, the length Lc from the output end of the crank rod 3 to the shaft 3*c*, and the length Ld of the connection rod 8 are not limited to dimensions as illustrated in figures. Each length may appropriate be changed to spread or thin the trajectory of the needlepoint from the conventional technology which moves the needle up and down by two components.

(2) To largely change the trajectory without large-sizing the driving mechanism of the needle, it is preferable that the length Lb is ½ to ¼ of the length Lc. When the length Lb is longer than ½ of the length Lc, the trajectory of the shaft 3*c* gets closer to a circle, and the driving mechanism is large-sized due to the enlarged length Ld of the connection rod 8. In contrast, when the length Lb is shorter than ¼ of the length Lc, the trajectory of the shaft 3*c* gets closer to a straight line, and the driving mechanism is the same as the conventional technology moving the needle up and down by two components.

(3) The length Lc and length Ld may be changed as appropriate when spreading and thinning the trajectory of the needle point. In that case, it is necessary that the length Lc and length Ld have certain difference, because if the difference between the length Lc and length Ld is little, the trajectory of the needle point does not differ so much from the conventional technology. If the length Ld is shorter than ½ of the minor axis of the ellipse drawn by the shaft 3*c*, the shaft 3*c* cannot draw the trajectory of the ellipse. On the other hand, if the length Ld is too long, the driving mechanism is large-sized, and therefore, it is preferable that the length Ld is in the length which the top dead center of the connection rod 8 is no longer than the top dead center of the crank 2.

(4) In the illustrated embodiments, the upper shaft 1 and the shuttle 9 are driven by the same motor to be synchronized with each other. However, the upper shaft 1 and the shuttle 9 can each be driven by separate motors. The zigzag sewing machine according to the second and the third embodiments may employ a single motor or a plurality of motors to move the needle dropping position in the lateral direction.

(5) In the illustrated embodiments, the guiding rod 7*c* which supports the slider 7 in a freely slidable manner is a bar-shaped component vertically provided to the frame of the sewing machine, but it is not limited thereto. For example, the needle bar 4 may be inserted to the guide hole 7*b* of the slider 7 in a freely slidable manner, so that the needle bar 4 itself has a function of the guide bar 7*c*. In this case, the guiding bar 7*c* is not necessarily required.

(6) The above embodiments are based on so-called horizontal rotation shuttle scheme, in which the shuttle rotates in the horizontal direction, however the scheme is not limited thereto. Other schemes, such as vertical half rotation shuttle scheme and vertical rotation shuttle scheme, etc. may be applied.

1 Upper shaft
2 crank
2*a* shaft
3 crank rod
3*a* shaft hole
3*b* shaft
3*c* shaft
4 needle bar
4*a* shaft
5 lifting guide
6 needle
7 slider
7*a* shaft hole
7*b* shaft hole
7*c* guide hole
8 connection rod
8*a* shaft hole
8*b* shaft hole
8*c* bearing
8*d* guiding shaft
9 shuttle
9*a* point of shuttle
9*b* shaft
10 motor
11 pulley
12 belt
13 pulley
14 belt

15 lower shaft
16 worm gear mechanism
20 upper bearing
21 lower bearing
22 upper supporting shaft
23 lower supporting shaft
24 needle bar supporter
24*a* upper arm
24*b* lower arm
24*c* perpendicular arm
25 shaft
26 swinging rod
27 oscillating link
28 motor
31 shaft
32 bush
33 guiding link
34 bearing
35 bearing
36 supporting shaft

What is claimed is:

1. A sewing machine comprising:

a needle bar supported by a needle bar supporter in a manner freely movable up and down relative to a frame;

an upper shaft supported in a direction horizontal to the frame, and rotated by a motor;

a crank fixed to the upper shaft, and having an output end that rotates;

a crank rod having an input end connected to the output end of the crank in a freely rotatable manner;

a slider provided to an output end of the crank rod in a manner freely movable up and down relative to the frame; and a connection rod having an input end connected to an intermediate portion between the input end of the crank rod and the output end of the crank rod in a freely rotatable manner, and having an output end connected to the needle bar in a freely rotatable manner, wherein a length from a connecting position of the connection rod and the crank rod to a connecting position of the slider and the crank rod and a length of the connection rod differ, and the length of the connection rod is shorter than the length from the connecting position of the connection rod and the crank rod to the connecting position of the slider and the crank rod.

2. The sewing machine according to claim 1, wherein the needle bar is supported by the needle bar supporter fixed to the frame in a manner freely movable up and down.

3. The sewing machine according to claim 1, further comprising:

a swinging rod moving the needle bar supporter between a right needle dropping position and a left needle dropping position.

4. The sewing machine according to claim 3, further comprising:

a supporting shaft provided to the frame in the vertical direction, wherein the needle bar supporter rotates in the horizontal direction by the swinging rod with the supporting shaft as a center.

5. The sewing machine according to claim 3, further comprising:

a supporting shaft provided to the frame in the horizontal direction, wherein the needle bar supporter rotates in the vertical direction by the swinging rod with the supporting shaft as a center.

6. The sewing machine according to claim 1, further comprising:

a guide bar supporting the slider in a manner freely movable up and down, wherein the guide bar is a component provided vertically to the frame.

7. The sewing machine according to claim 1, wherein the needle bar works as a guide bar supporting the slider in a manner freely movable up and down.

* * * * *